United States Patent [19]

Reudink et al.

[11] 4,166,274

[45] Aug. 28, 1979

[54] TECHNIQUES FOR COPHASING ELEMENTS OF A PHASED ANTENNA ARRAY

[75] Inventors: Douglas O. Reudink, Sea Girt; Yu S. Yeh, Freehold Township, Monmouth County, both of N.J.

[73] Assignee: Bell Telephone Laboratories, Incorporated, Murray Hill, N.J.

[21] Appl. No.: 911,827

[22] Filed: Jun. 2, 1978

[51] Int. Cl.[2] ..... H01Q 3/26

[52] U.S. Cl. ..... 343/100 SA; 343/854

[58] Field of Search ..... 343/100 SA, 854, 100 TD

[56] References Cited

U.S. PATENT DOCUMENTS

| | | | |
|---|---|---|---|
| 3,140,490 | 7/1964 | Sichak et al. | 343/100 SA |
| 3,271,770 | 9/1966 | Lees | 343/100 TD |
| 3,378,846 | 4/1968 | Lowenschuss | 343/100 SA |
| 3,453,623 | 7/1969 | Blackband et al. | 343/100 R |
| 3,646,558 | 2/1972 | Campanella | 343/100 SA |
| 3,757,336 | 9/1973 | Rosen | 343/100 ST |

OTHER PUBLICATIONS

Markow, "Servo Phase Control Shapes Antenna Pattern", Electronics, Jan. 2, 1959, pp. 50–52.

*Primary Examiner*—Maynard R. Wilbur
*Assistant Examiner*—Richard E. Berger
*Attorney, Agent, or Firm*—Erwin W. Pfeifle

[57] ABSTRACT

The present invention relates to a method of cophasing the feed elements of a transmitting or a receiving phased array antenna. To cophase a transmitting antenna, the method entails transmitting a lower sideband and an upper sideband signal from a first and a second one of the feed elements, respectively, while transmitting a carrier signal used to generate the sideband signals on all other feed elements of the array. At each receiver the reference phase angle between the received sideband signals is measured and stored. The above step is sequentially repeated for the first and a third, the first and a fourth, etc., one of the feed elements, and the phase angle measured, subtracted from the reference phase angle, and stored. With the above method, the phase angle between each feed element and the second one of the feed elements is determined and stored and subsequently transmitted back to the transmitter for use in transmitting signals to each receiver. To cophase a receiving antenna, a received signal is modulated at sequential pairs of the feed elements to produce the upper and lower side-band signals and enable the above cophasing sequence to be performed.

12 Claims, 5 Drawing Figures

TECHNIQUES FOR COPHASING ELEMENTS OF A PHASED ANTENNA ARRAY

BACKGROUND OF THE INVENTION

1. Field of the Invention

The present invention relates to techniques for cophasing the elements of a transmitting or receiving phased array antenna and, more particularly, to techniques for cophasing the elements of a phased array antenna wherein to determine the phase setting between any two feed elements, an upper and a lower sideband signal are concurrently provided at a first one and a second one of the feed elements, respectively, and next at the first one and a third one of the feed elements, respectively, to permit the estimated phase angle between the concurrent sideband signals to be measured and then compared with each other to determine the phase setting to be used for the third one of the feed elements with respect to the second one of the feed elements.

2. Description of the Prior Art

Phased antenna arrays having directive characteristics are well known in the art and are preferred for certain applications over omni-directional antennas since a directional antenna provides greater signal-to-noise ratio and, of course, better gain. However, to provide a beam of electromagnetic energy in a certain direction, the individual elements of the phased array must be properly cophased. One technique for cophasing the elements for a particular directional wavefront is to compute the expected phasings and then store such phasings in the phase controller associated with the array for subsequent use. Once computed and stored, such phase settings are not changeable and are used regardless of conditional changes which may occur until new phase settings are computed and stored.

Typical prior art techniques for providing a more active rather than passive cophasing scheme are disclosed in, for example, the following references. U.S. Pat. No. 3,140,490 issued to W. Sichak et al on July 7, 1964 relates to a communication system with automatic antenna beam steering wherein the induced signal at one antenna is modulated with a constant frequency signal and is compared with the original modulating signal so that when an out-of-phase condition is noted a control signal is generated to cause a phase shift in the first antenna signal to produce an in-phase condition.

U.S. Pat. No. 3,271,770 issued to A. B. Lees on Sept. 6, 1966 relates to an antenna phasing control system for adjusting the relative phasing of electrical energy applied to individual antennas in an array in accordance with the phase conjugate of the signals received by the individual antennas. A control signal is generated to alter the relative phasing of a master oscillator signal to place the radiated signal at the associated antenna in phase conjugate with the received signal.

U.S. Pat. No. 3,378,846 issued to O. Lowenschuss on Apr. 16, 1968 relates to method and apparatus for testing and aligning each of N elements in a phased array antenna. More particularly, each element has a separate phase shifter associated therewith which phase shifter is individually controlled by B control bits from a common command circuit. By checking the amplitude and phase changes of the received signal it can be determined if each element is operable and aligned and appropriate remedies applied if the element is inoperable or misaligned.

U.S. Pat. No. 3,453,623 issued to W. T. Blackband et al on July 1, 1969 relates to a phased-optimized antenna system comprising two aerials having uneven polar sensitivity characteristics. There, a phase sensitive detector receives separate signals from a perturbation oscillator and the perturbation signal from a common signal path and generates output control signals to control the individual phase shifters and bring the signals associated with the two aerials into phase with each other.

The problem remaining in the prior art, however, is to provide a technique for permitting the phase of each element of a phased antenna array to be accurately and actively determined to permit a planar wavefront to be launched to or received from a distant location by such antenna and to be easily maintained despite possible changes in the phase setting requirements of the individual elements of the array due to thermal and aging effects.

BRIEF SUMMARY OF THE INVENTION

The foregoing problem has been solved with the present invention which relates to techniques for cophasing the elements of a transmitting or receiving phased antenna array to provide directional planar wavefronts towards one or more remote receiving stations and, more particularly, to techniques for cophasing the elements of a phased array antenna wherein to determine the phase setting between any two feed elements, an upper and a lower sideband signal are concurrently provided at a first one and a second one of the feed elements, respectively, and next at the first one and a third one of the feed elements, respectively, to permit the estimated phase angle between the concurrent sideband signals to be measured and then compared with each other to determine the phase setting to be used for the third one of the feed elements with respect to the second one of the feed elements.

It is an aspect of the present invention to provide techniques wherein all but two feed elements of the array are simultaneously associated with a directional signal $\omega_c$. Concurrent therewith, the first and the second remaining elements are associated with a reference signal $\omega_c-\omega_p$ and a signal $\omega_c+\omega_p$, respectively, and the reference estimated phase angle between these latter signals measured at the receiving ground location. In a predetermined sequence thereafter, which is dependent on which variation of the present techniques is used, the method is repeated for each of the other elements of the array, using the first remaining element each time and a different one of the other elements of the array to measure the estimated phase angle received at the ground location between the two elements concurrently under test which is compared with the reference estimated phase angle to give the precise phase angle setting for that element compared to the second element of the phased array. This method can be repeated every so often since in the environment of space, drifts will occur in the individual phase settings due to thermal and aging effects. Once the method is completed, the determined phase settings for the elements of the remote transmitting array for directing a beam towards a particular ground receiving location are transmitted via telemetry signals to the remote transmitter for storage and use by the phase controller in subsequently directing a beam to that particular receiving ground location, or stored at the receiver for a receiving phased array antenna.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

The following description illustrates three methods for cophasing the individual feed elements of a phased antenna array in accordance with the present invention. Which of the methods chosen is dependent on the duration allowable for performing the method and/or the accuracy of the resultant phase settings. Although the present methods can advantageously be used for setting the phase of each feed element of a phased array antenna, the present methods are very useful with, for example, a receiving or a transmitting phased array antenna used in a fixed or scanning beam satellite communication system where the directionality of the individual feed elements may have to be changed for reasons of either scanning purposes, movement of the satellite, or thermal or aging effects of the feed elements.

Figure 1:
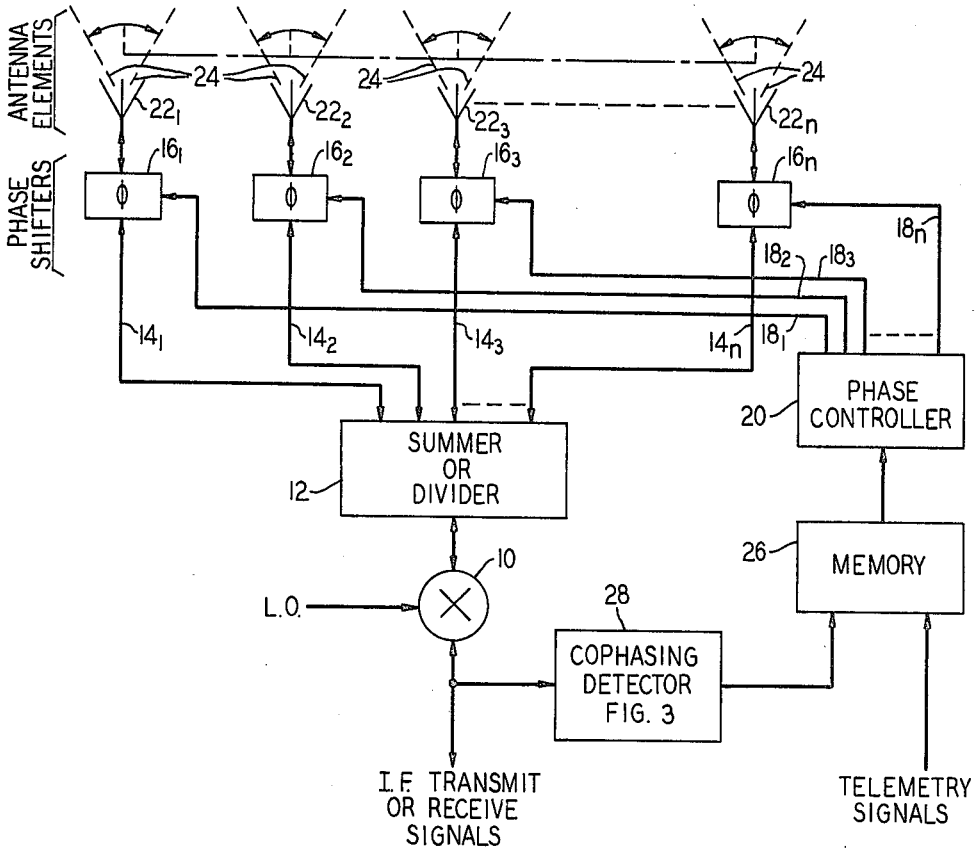
FIG. 1 is a block diagram of a typical prior art phased array system with a cophasing detector and/or a phase controller in accordance with the present invention capable of implementing the present cophasing techniques.
Figure 3:
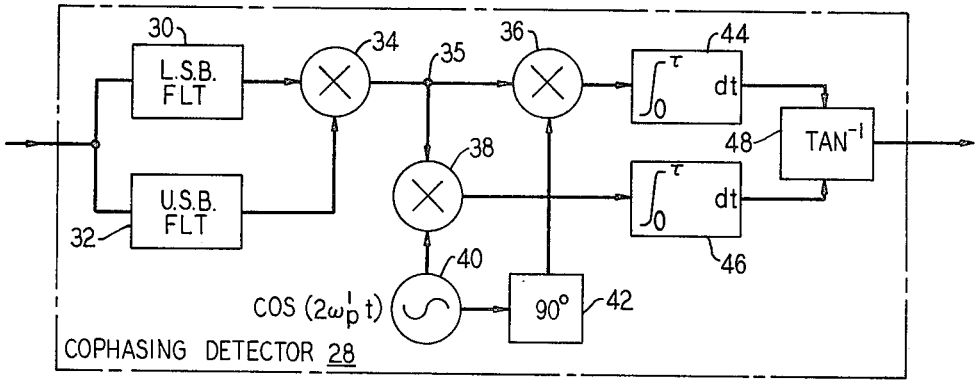
FIG. 3 illustrates a block diagram of a cophasing detection circuit capable of processing the burst formats of FIGS. 2, 4 or 5 for determining the proper phase settings for the feed elements of an n element array for a particular direction of transmission or reception.

A typical arrangement for implementing the present cophasing techniques is shown in FIG. 1. For a transmitting phased array system, an intermediate frequency (I.F.) input signal is mixed in mixer 10 with a local oscillator (L.O.) signal to provide a microwave frequency to a divider 12. Divider 12 divides the input signal into n equal components which are distributed via leads $\mathbf{14}_1$–$\mathbf{14}_n$ to phase shifters $\mathbf{16}_1$–16n, respectively. Concurrent with the reception of signals on leads $\mathbf{14}_1$–$\mathbf{14}_n$, phase shifters $\mathbf{16}_1$–$\mathbf{16}_n$ receive control signals on leads $\mathbf{18}_1$–$\mathbf{18}_n$, respectively, from a phase controller 20 to appropriately shift the phase of the signals received on leads $\mathbf{14}_1$–$\mathbf{14}_n$ and modulate these divided microwave signals in accordance with the present cophasing techniques. The resultant signals from phase shifters $\mathbf{16}_1$–$\mathbf{16}_n$ are applied to antenna feed elements $\mathbf{22}_1$–$\mathbf{22}_n$ to launch a beam 24 of electromagnetic energy in the direction dictated by the signals from phase shifters $\mathbf{16}_1$–$\mathbf{16}_n$ as is well known in the art. A memory 26 is used to store the necessary phase information and the signal application sequence for implementing the present cophasing techniques which will become clear with the discussion hereinafter relating to FIGS. 2, 4 and 5.

Where feed elements $\mathbf{22}_1$–$\mathbf{22}_n$ are used as a receiving phased array antenna, the signals in beam 24 received by each of feed elements $\mathbf{22}_1$–$\mathbf{22}_n$ are applied to phase shifters $\mathbf{16}_1$–$\mathbf{16}_n$, respectively, concurrent with the application of the control signals and cophasing sequence signals on respective leads $\mathbf{18}_1$–$\mathbf{18}_n$ from phase controller 20. The resultant signals on leads $\mathbf{14}_1$–$\mathbf{14}_n$ are applied as inputs to summing circuit 12 and the resultant signal is mixed in mixer 10 with a local oscillator signal to provide an I.F. receive signal. The I.F. receive signal is used as an input to a cophasing detector 28 which is shown in FIG. 3 and described hereinafter when the cophasing technique is performed. The phase settings determined by cophasing detector 28 are read into memory 26 to replace prior settings used with each direction of reception.

For determining the phase settings for each of feed elements $\mathbf{22}_1$–$\mathbf{22}_n$ for the transmission of a beam 24 towards any remote receiving station, beam 24 is transmitted containing cophasing signals as will be described hereinafter. The remote receiving station comprises a cophasing detector 28, as shown in FIG. 3, which determines from the received signals the phase settings required at the distant transmitter for each feed element of the transmitting phased array to enable beam 24 to be accurately aimed at the receiving station. These determined phase settings are transmitted by the receiving station back to the transmitting station via telemetry signals for storage in memory 26 for subsequent use by the transmitting antenna in sending signals back to the receiving station.

Figure 2:
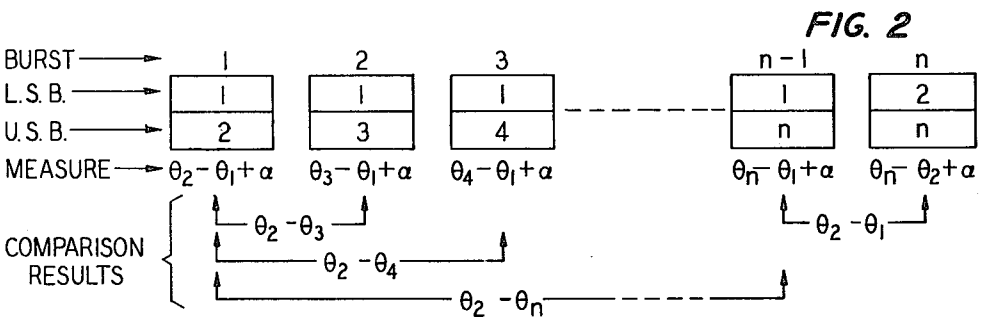
FIG. 2 illustrates an exemplary burst sequence for determining the phase setting for each of the feed elements of an n element phased antenna array for any direction of transmission or reception in accordance with the present invention.
Figure 4:
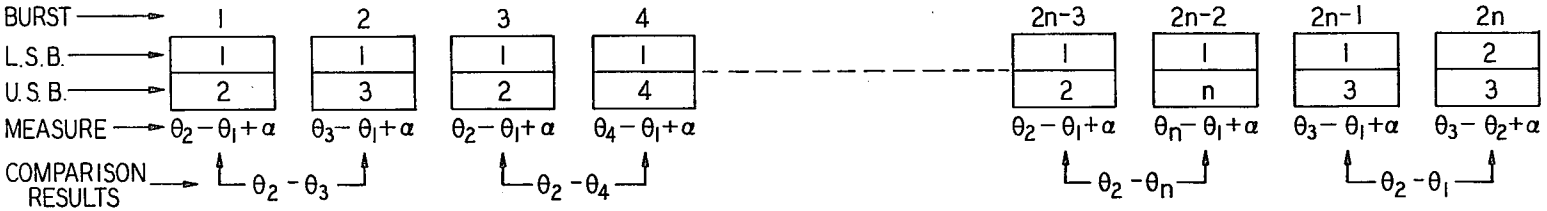
FIG. 4 illustrates another exemplary burst sequence for determining the phase setting for each of the feed elements of an n element phased antenna array for any direction of transmission or reception in accordance with the present invention.
Figure 5:
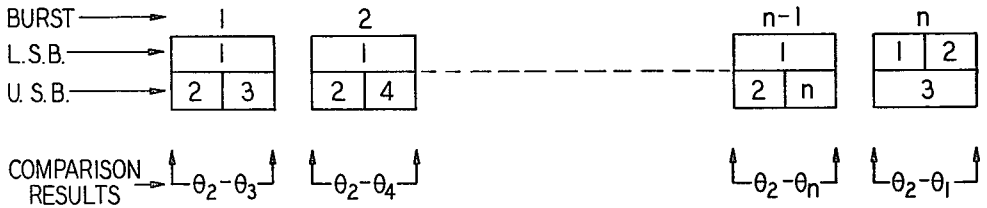
FIG. 5 illustrates yet another exemplary burst sequence for determining the phase setting for each of the feed elements of an n element phased antenna array for any direction of transmission or reception in accordance with the present invention.

To effect the present cophasing techniques, phase controller 20 advances or retards each phase shifter 16 in periodic steps at fairly high rates which can include rates even in the megahertz range. Therefore, phase controller 20 will hereinafter be considered to be capable of injecting a continuous or sequentially different phase shift on each of feed elements $\mathbf{22}_1$–$\mathbf{22}_n$, or equivalently, producing a carrier offset on any selected feed element 22 of the phased array. The present cophasing techniques are implemented using a minimum of n sequential bursts for an n feed element feed array as is shown in FIGS. 2, 4 and 5. It is to be understood that such sequential bursts can take the form of, for example, one or more dedicated subframe intervals or a dedicated frame interval in a super frame sequence of a known time division multiple access (TDMA) communication sequence. Additionally, each burst interval can comprise any predetermined duration and is primarily dependent on the carrier-to-noise ratio desired in the cophasing detector 28. For purposes of illustration only, it will be assumed hereinafter that each burst interval is 250 $\mu$sec which is dedicated to the cophasing of the array feed elements $\mathbf{22}_1$–$\mathbf{22}_n$.

During the first burst interval of the present cophasing sequence, a continuous wave (CW) carrier signal, $\omega_c$, is transmitted by feed elements $\mathbf{22}_3$–$\mathbf{22}_n$ while feed element $\mathbf{22}_1$ and feed element $\mathbf{22}_2$ transmit the carrier signal offset by $-\omega_p$ and $+\omega_p$, respectively, as shown in FIG. 2. Each remote receiving station receives the signal $$y = e^{(j\omega_c t - j\omega_p t + \theta_1)} + e^{(j\omega_c t + j\omega_p t + \theta_2)} + Ee^{(j\omega_c + \psi)} \quad (1)$$

where $\theta_1$ and $\theta_2$ are the radio frequency (RF) phase of feed elements 1 and 2, respectively, and $Ee^{(\omega_c + \psi)}$ is the combination of the rest of the array elements and the maximum of E is n−2 while $\psi$ is the received phase angle. For purposes of clarity, front end noise of the receiver, although present, will be disregarded in the present description. In equation (1), the first term represents the lower sideband (LSB) signal originally transmitted by feed element $\mathbf{22}_1$ (No. 1) of the transmitting array, the second term represents the upper sideband (USB) signal originally transmitted by feed element $\mathbf{22}_2$ (No. 2), and the last term represents the composite signal originally transmitted by feed elements $\mathbf{22}_3$–$\mathbf{22}_n$.

Each remote receiving station comprises a cophasing detector 28 which is shown in block form in FIG. 3 as comprising a narrowband lower sideband (LSB) filter 30 and a narrowband upper sideband (USB) filter 32 connected in parallel and tuned to pass the signals $\omega_c - \omega_p$ and $\omega_c + \omega_p$, respectively. The bandwidth of filters 30 and 32, however, should be sufficient to pass the burst pulses, e.g., 4 kHz for a 250 μsec burst and 8 kHz for a 125 μsec burst, with little distortion. Filters 30 and 32 should also be capable of eliminating the carrier term $Ee^{(j\omega_c t + j\psi)}$ and such requirements can be met, for example, with four pole Butterworth filters having 3 dB bandwidths of 200 kHz. The output of filters 30 and 32 are $$y_1 = \cos(\omega_c t - \omega_p t + \theta_1) \text{ and} \quad (2)$$

$$y_2 = \cos(\omega_c t + \omega_p t + \theta_2), \quad (3)$$

respectively.

The output signals $y_1$ and $y_2$ are next mixed in a mixer 34 to obtain the lower sideband product of $$z_2 = [2\omega_p t + (\theta_2 - \theta_1)]. \quad (4)$$

The signal $z_2$ is equally divided at point 35 by any suitable means such as, for example, a hybrid circuit or a solder joint, and applied to mixers 36 and 38 where the divided components of signal $z_2$ are mixed with locally generated signals $\sin(2\omega_p' t)$ and $\cos(2\omega_p' t)$, respectively. These latter two signals can be generated by a stable local oscillator 40 which generates a signal $\cos(2\omega_p' t)$ for direct application to mixer 38 and via a 90 degree phase shift circuit 42 to apply the signal $\sin(2\omega_p' t)$ to mixer 36. The outputs from mixers 36 and 38 are applied to matched integrating circuits 44 and 46, respectively, and the outputs therefrom applied directly to an arc Tan circuit 48, the output of which indicates the estimated phase of $\theta_2 - \theta_1$ given by the expression $$\hat{\theta}_2 - \hat{\theta}_1 = \theta_2 - \theta_1 + \alpha, \quad (5)$$

where $\alpha$ is the difference in phase between the signals $\cos(2\omega_p t)$ and $\cos(2\omega_p' t)$ generated at the transmitter and receiving station local oscillators, respectively. This measured result is indicated below the first dedicated cophasing burst interval of the sequence shown in FIG. 2. The estimated phase of equation (5) is then stored for subsequent use. Circuits 44, 46 and 48 can comprise any suitable circuit to provide the function indicated as, for example, such circuits which are presently available in integrated circuit form.

During the second dedicated cophasing burst interval of the present cophasing sequence, a CW carrier signal is transmitted by feed elements $\mathbf{22}_2$ and $\mathbf{22}_4$–$\mathbf{22}_n$ while feed element $\mathbf{22}_1$ and feed element $\mathbf{22}_3$ transmit the carrier signal offset by $-\omega_p$ and $+\omega_p$, respectively as indicated in the block of FIG. 2. At each receiving station, the cophasing detector repeats the process described hereinbefore for the first cophasing burst interval to provide the estimated phase of $$\hat{\theta}_3 - \hat{\theta}_1 = \theta_3 - \theta_1 + \alpha. \quad (6)$$

The stored value obtained in equation (5) is then compared with the result obtained in equation (6) to eliminate the $\alpha$ term and provide a resultant phase angle of $\theta_2 - \theta_3$ which corresponds to the phase setting of feed element $\mathbf{22}_3$ with respect to feed element $\mathbf{22}_2$ at the transmitting phased array for that particular receiving station. This phase setting which is determined at each receiving station is temporarily stored for subsequent transmission back to the transmitting station via telemetry signals for storage in memory 26.

Similarly, during each of the third to (n−1) cophasing burst intervals of the present cophasing sequence shown in FIG. 2, feed element $\mathbf{22}_1$ transmits the carrier signal offset by $-\omega_p$ while elements $\mathbf{22}_3$–$\mathbf{22}_n$, respectively, transmit the carrier signal offset by $+\omega_p$ during their individually associated burst interval. During each burst interval, the remaining feed elements are transmitting the CW carrier signal, and at each receiving station the cophasing detector determines the estimated phase difference between the two offset received signals. The estimated phase difference determined for each cophasing burst interval is then compared with the stored estimated phase value of equation (5) to determine the phase setting of the feed element transmitting the USB signal in each burst interval in relationship to the second feed element $\mathbf{22}_2$ of the transmitting array as was described hereinbefore.

An $n^{th}$ pulse is used in the cophasing sequence to obtain a phase setting of feed element $\mathbf{22}_2$ with respect to feed element $\mathbf{22}_1$ so as to eliminate the $\alpha$ term contained in the estimated phase setting obtained with the first cophasing burst interval of the sequence as shown in equation (5). The phase setting $\theta_2 - \theta_1$ can be obtained in many ways, one of which is shown in FIG. 2. There, in the last burst interval of the sequence, feed element $\mathbf{22}_2$ transmits the carrier signal offset by $-\omega_p$ while feed element $\mathbf{22}_n$ transmits the carrier signal offset by $+\omega_p$ with feed elements $\mathbf{22}_1$ and $\mathbf{22}_3$–$\mathbf{22}_{n-1}$ transmitting the CW carrier signal. At each receiver the cophasing detector determines the estimated phase between feed element $\mathbf{22}_n$ and $\mathbf{22}_2$ as $$\hat{\theta}_n - \hat{\theta}_2 = \theta_n - \theta_2 + \alpha \quad (7)$$

in the manner described hereinbefore for the determining of the estimated phase between feed elements in the other cophasing burst intervals. This estimated phase is compared with the estimated phase obtained in the immediately previous burst interval between feed element $\mathbf{22}_n$ and feed element $\theta_1$ as $\theta_n - \theta_1 + \alpha$ to determine the actual phase setting for feed element $\mathbf{22}_2$ with respect to feed element $\mathbf{22}_1$. From the cophasing sequence of FIG. 2, the phase setting of feed element $\mathbf{22}_2$ with respect to feed element $\mathbf{22}_1$ is found and the phase setting for each of elements $\mathbf{22}_3$–$\mathbf{22}_n$ with respect to feed element $22_2$ is also found at each receiving station for permitting the remote transmitting phased array to direct a planar wavefront beam at the associated receiving station. These phase settings are then transmitted back to the transmitter for storage in memory 26 for subsequent use in directing a beam towards a desired receiving station.

An alternative method of determining the phase settings for $\theta_2-\theta_1$ is to use an intermediate pulse in the sequence of FIG. 2 and transmit the lower and upper sideband signals on feed element $22_2$ and one of the feed elements $22_3$–$22_{n-1}$ to obtain an estimated phase value which can be compared with some priorly obtained estimated phase value to generate a $\theta_2-\theta_1$ phase setting. For example, if during the third burst interval of FIG. 2, feed elements $22_2$ and $22_3$ were to transmit the carrier signal offset by $-\omega_p$ and $+\omega_p$, respectively, then at the cophasing detector of each receiving station the estimated phase setting of $\theta_3-\theta_2+\alpha$ would be determined. This estimated phase value could then be compared with the estimated phase setting $\theta_3-\theta_1+\alpha$ obtained in the second burst interval of the sequence to arrive at the $\theta_2-\theta_1$ phase setting.

In the sequence of FIG. 2, some very minor error may become included in the phase settings. These very minor errors evolve from the fact that $\alpha$ in each of the estimated phase values may not be precisely the same as that of the other estimated phase values since the value of 2 $\omega_p$ generated at the transmitter is not precisely locked to the local oscillator 40 in the cophasing detectors at each remote receiving station. For example, in the sequence of FIG. 2, in the comparison of the estimated phase settings obtained from cophasing burst intervals 1 and 2 may contain no error since the time duration is relatively small and there would be no noticeable change in $\alpha$. However, when comparing the estimated phase settings determined in cophasing burst intervals 1 and n, a much longer time interval has elapsed and there may be some change in $\alpha$ by a slight drift between the two remote oscillators from which $\alpha$ is derived. Therefore, the longer the time interval between the determination of the estimated phase settings which are compared, the greater the possibility of there being a change in $\alpha$ and, in turn, a very slight error in the determined phase setting.

The present cophasing sequences shown in FIGS. 4 and 5 represent variations of the cophasing sequence shown in FIG. 2 to virtually eliminate the hereinabove indicated errors which may be introduced by the sequence of FIG. 2. In the sequence shown in FIG. 4, the first two cophasing burst intervals are the same at the first two burst intervals shown in FIG. 2 for obtaining the phase setting of feed element $22_3$ with respect to feed element $22_2$ of FIG. 1 for directing a beam at each receiving station as described hereinbefore. Except for the last two burst intervals of the cophasing sequence, the sequence associates adjacent pairs of burst intervals, with the first burst interval of each pair repeating the transmission of the first burst interval of the sequence and each second interval of the pairs being used to repeat the sequence of bursts 2 to (n−1) of the sequence of FIG. 2. For example, in burst interval 3 of FIG. 4, the procedure of the burst interval 1 is repeated to obtain the estimated phase setting of $\theta_2-\theta_1+\alpha$ and in the associated burst interval 4 the procedure for the third burst interval of FIG. 2 is performed to obtain the estimated phase setting of $\theta_4-\theta_1+\alpha$. These estimated values obtained in burst intervals 3 and 4 of FIG. 4 are then compared to obtain the actual phase setting for feed element $22_4$ with respect to feed element $22_2$ of FIG. 1. Similarly, in burst interval $2n-3$ the procedure for burst interval 1 is repeated to obtain the estimated phase setting of $\theta_2-\theta_1+\alpha$ and in associated burst interval $2n-2$ the procedure for the burst interval n−1 of FIG. 2 is performed to obtained the estimated phase setting of $\theta_n-\theta_1+\alpha$ which two estimated phase settings are compared to derive the actual phase setting of feed element $22_n$ in relationship to feed element $22_2$ of FIG. 1.

As can be seen in FIG. 4, each of the actual phase settings for each of the feed elements $22_3$–$22_n$ in relationship to feed element $22_2$ is determined using adjacent burst intervals which thereby substantially eliminates the possibility of having an error included in the actual phase setting since the chance of $\alpha$ being different in compared values is substantially eliminated in comparison to the cophasing sequence of FIG. 2. The last two burst intervals in FIG. 4 are used to enable the determination of the actual phase setting of feed element $22_2$ with respect to feed element $22_1$ and can be accomplished using various combinations of paired burst intervals. As shown in FIG. 4, this can be accomplished by transmitting in burst $2n-1$ the carrier signal offset by $-\omega_p$ and $+\omega_p$ by feed elements $22_1$ and $22_3$, respectively, to determine the estimated phase setting of $\theta_{3-\theta1}+\alpha$ at each of the receiving stations. Then in burst interval $2n$, feed elements $22_2$ and $22_3$ can be made to transmit the carrier signal offset by $-\omega_p$ and $+\omega_p$, respectively, to determine the estimated phase setting of $\theta_3-\theta_2+\alpha$. These latter two estimated phase settings are then compared to derive the actual phase setting for feed element $22_2$ with respect to feed element $22_1$.

Alternatively, in burst interval $2n-1$ of FIG. 4, the procedure used in burst interval n of FIG. 2 could be used to derive the estimated phase setting of $\theta_n-\theta_2+\alpha$ which can be compared with the estimated phase setting of $\theta_n-\theta_1+\alpha$ derived in burst interval $2n-2$ of FIG. 4 to determine the actual phase setting of feed element $22_2$ with respect to feed element $22_1$ similar to that shown when comparing the estimated phase settings determined in burst intervals n−1 and n of FIG. 2. Therefore, the cophasing sequence of FIG. 4 provides phase settings for each of the feed elements $22_1$–$22_n$ which are essentially more accurate since such phase settings are less likely to have errors included therein. This improved accuracy, however, is achieved at the expense of using approximately twice as much time since the cophasing sequence of FIG. 2 requires n exemplary 250 μsec burst intervals while the cophasing of FIG. 4 requires either $(2n-1)$ or $2n$ exemplary 250 μsec burst intervals.

The cophasing sequence of FIG. 5 in accordance with the present invention uses only n exemplary 250 μsec burst intervals while providing the accuracy found with the cophasing sequence of FIG. 4. In the first burst interval feed element $22_1$ transmits the carrier signal offset by $-\omega_p$ for the full length of the burst interval while feed elements $22_2$ and $22_3$ transmit the carrier signal offset by $+\omega_p$ for the first and second half, respectively, of the burst interval. During the first and second 125 μsec portion of the exemplary first burst interval, each receiving station is capable of determining with its cophasing detector 28, the estimated phase settings of $\theta_2-\theta_1+\alpha$ and $\theta_3-\theta_1+\alpha$, respectively, which are then compared to arrive at the actual phase setting for feed element $22_3$ with respect to feed element $22_2$. Therefore, the actual phase setting derived by the transmissions during the first cophasing burst interval of FIG. 5 corresponds to that occurring in cophasing burst intervals 1 and 2 of the sequences shown in FIGS. 2 and 4. Similarly, during the second burst intervals of the sequence of FIG. 5, the procedure of the first burst interval is repeated except that during the second half of the burst interval feed element $22_4$, rather than feed element $22_3$, transmits the carrier signal offset by $+\omega_p$ to enable each receiver to determine the actual phase setting of feed element $22_4$ with respect to feed element $22_2$. The procedure of the second burst interval corresponds to that accomplished with burst intervals 1 and 3 of FIG. 2 and 3 and 4 of FIG. 4. The remaining sequential burst intervals 3 to (n−1) of the cophasing sequence of FIG. 5 provide for transmission by feed element $22_1$ of the carrier signal offset by $-\omega_p$ for the full period of each burst interval while the feed elements $22_2$ and feed elements $22_5$–$22_n$, respectively, transmit the carrier signal offset by $+\omega_p$ during the respective first and second half of the burst intervals. The sequence of FIG. 5, therefore is shown as having each burst interval corresponding to the cophasing transmissions with respect to the sequential pairs of burst intervals of FIG. 4. With the cophasing sequence of FIG. 5, however, the carrier-to-noise ratio will be less than that achieved with the sequences shown in FIGS. 2 and 4, when all sequences use the same exemplary burst interval duration, since the time duration for the concurrent transmission of the appropriate LSB and USB signal to determine each estimated phase setting is only half that used in the cophasing sequence of FIGS. 2 and 4.

To cophase the feed elements of a receiving phased array antenna, the sequence of either FIGS. 2, 4 or 5 can be used. At the receiving antenna, a planar wavefront signal received from a particular direction is used for the cophasing sequence and represents the carrier signal which is then offset at two of the elements during each cophasing burst interval by the phase controller 20 at the receiving station in accordance with the cophasing sequence used. During each cophasing burst interval, cophasing detector 28 determines the estimated phase settings used to derive the actual phase settings for each of the feed elements $22_1$–$22_n$ as described hereinbefore. The derived actual phase settings are subsequently used to direct the receiving phased array at that particular direction at the time the signal is expected therefrom.

It is to be understood that the above-described embodiments are simply illustrative of the principles of the invention. Various other modifications and changes may be made by those skilled in the art which will embody the principles of the invention and fall within the spirit and scope thereof. For example, in each of the exemplary cophasing sequences shown in FIGS. 2, 4 and 5, it is only necessary that the actual phase settings for the various feed elements be obtained with respect to a reference feed element, which can be other than feed element $22_2$ as shown in each of the cophasing sequences, and that the phase setting of the reference feed element with respect to feed element $22_1$ be found.

We claim:

1. A method of cophasing each of a plurality of n feed elements which form a phased array antenna at a remote transmitter

CHARACTERIZED IN THAT the method comprises the steps of:

during a predetermined recurring interval of time in a transmission sequence, at a receiving station (a) receiving from the remote transmitter a lower sideband reference signal of a first signal ($\omega_c$) modulated with a second signal ($\omega_p$) which was transmitted by a first one of the feed elements of the transmitting phased array antenna;

(b) concurrent with step (a), receiving from the remote transmitter an upper sideband signal of the first signal ($\omega_c$) modulated by the second signal ($\omega_p$) which was transmitted by a second one of the feed elements of the transmitting phased array antenna;

(c) measuring and storing the phase angle between the upper and lower sideband signals received in steps (a) and (b) which is representative of the phase setting between the first and second one of the feed elements which transmitted the lower and upper sideband signals, respectively;

(d) reiterating step (a);

(e) concurrent with step (d), receiving from the remote transmitter an upper sideband signal of the first signal ($\omega_c$) modulated by the second signal ($\omega_p$) which was transmitted by a third one of the feed elements of the transmitting phased array antenna;

(f) measuring the phase angles between the upper and lower sideband signals received in steps (d) and (e) which is representative of the phase setting between the first and said third one of the feed elements;

(g) determining the difference between the phase angles measured in steps (c) and (f), which difference is representative of the actual phase setting for said third one of the feed elements used in step (e) with respect to the second one of the feed elements used in step (c); and (h) transmitting the actual phase setting obtained in step (g) back to the remote transmitter for subsequent use in transmitting signals back to the receiving station.

2. The method according to claim 1

CHARACTERIZED IN THAT the method comprises the further step of:

(i) reiterating steps (d) to (h) while using a different one of the fourth to n ones of the feed elements of the transmitting phased array antenna for the third one of the feed elements of step (f) in each reiteration of steps (e) to (g).

3. The method according to claim 1 or 2

CHARACTERIZED IN THAT the method comprises the additional steps of:

(j) performing steps (a) and (b) during a first one of the predetermined recurring intervals of time in the transmission sequence; and (k) performing steps (d) and (e) during a second one of the predetermined recurring intervals of time in the transmission sequence.

4. The method according to claim 1 or 2

CHARACTERIZED IN THAT the method comprises the further steps of:

(j) performing steps (a) and (b) during a first portion of a particular predetermined recurring interval of time of the transmission sequence; and (k) performing steps (d) and (e) during a second portion of said particular predetermined recurring interval of time of the transmission sequence used in step (j).

5. The method according to claim 1

CHARACTERIZED IN THAT the method comprises the further steps of:

(i) receiving from the remote transmitter a lower sideband signal of the first signal ($\omega_c$) modulated with the second signal ($\omega_p$) which was transmitted by said second one of the feed elements of the transmitting phased array antenna;

(j) concurrent with step (i), receiving from the remote transmitter an upper sideband signal of the first signal ($\omega_c$) modulated with the second signal ($\omega_p$) which was transmitted by said third one of the feed elements;

(k) measuring the phase angle between the upper and lower sideband signals received in steps (i) and (j) which phase angle is representative of the phase setting between the second and the third ones of the feed elements;

(l) determining the difference between the phase angles measured in steps (f) and (k), which difference is representative of the actual phase setting for said second one of the feed elements with respect to said first one of the feed elements; and (m) transmitting the actual phase setting obtained in step (l) back to the remote transmitter for subsequent use in transmitting signals back to the receiving station.

6. The method according to claim 2
CHARACTERIZED IN THAT
the method comprises the further steps of:

(j) receiving from the remote transmitter a lower sideband signal of the first signal ($\omega_c$) modulated with the second signal ($\omega_p$) which was transmitted by the second one of the feed elements of the transmitting phased array antenna;

(k) receiving from the remote transmitter an upper sideband signal of the first signal ($\omega_c$) modulated with the second signal ($\omega_p$) which was transmitted by one of the third to n ones of the feed elements of the transmitting phased array antenna;

(1) measuring the phase angle between the upper and lower sideband signals received in steps (j) and (k) which phase angle is representative of the phase setting between said third to n one of the feed elements used in step (k) and the second one of the feed elements;

(m) determining the difference between the phase angle measured in step (1) and the phase angle measured in step (i) when the reiterated step (f) used the same feed element as used with step (k), which difference is representative of the actual phase setting for said second one of the feed elements with respect to said first one of the feed elements; and (n) transmitting the actual phase settings obtained in steps (m) back to the remote transmitter for subsequent use in transmitting signals back to the receiving station.

7. A method of cophasing a plurality of n feed elements which form a phase array antenna at a receiving station, the method comprising the step of:

during a predetermined receiving interval of time, (a) receiving at each of the plurality of n feed elements a first signal ($\omega_c$) arriving from a particular direction;

CHARACTERIZED IN THAT
the method comprises the further steps of:

(b) modulating the first signal ($\omega_c$) received by a first one of the plurality of n feed elements (e.g., $22_1$) with a second signal ($\omega_p$) to produce a lower sideband reference signal thereof;

(c) concurrent with step (b), modulating the first signal ($\omega_c$) received by a second one of the plurality of n feed elements (e.g., $22_2$) with the second signal ($\omega_p$) to produce an upper sideband signal thereof;

(d) measuring and storing the phase angle between the upper and lower sideband signals generated in steps (b) and (c) which is representative of the phase settings between the first and second one of the feed elements;

(e) reiterating step (b);

(f) concurrent with step (e), modulating the first signal ($\omega_c$) received by a third one of the plurality of n feed elements with the second signal ($\omega_p$) to produce an upper sideband signal thereof;

(g) measuring the phase angle between the upper and lower sideband signals generated in steps (e) and (f) which is representative of the phase setting between the first one and said third one of the plurality of n feed elements; and (h) determining the difference between the phase angles measured in steps (d) and (g), which difference is representative of the actual phase setting for said third one of the feed elements used in step (f) with respect to the second one of the feed elements used in step (d).

8. The method according to claim 7
CHARACTERIZED IN THAT
the method comprises the further step of:

(i) reiterating steps (e) to (h) while using a different one of the fourth to n ones of the plurality of n feed elements for the third one of the feed elements of step (f) in each reiteration of steps (e) to (h).

9. The method according to claim 7 or 8
CHARACTERIZED IN THAT
the method comprises the additional steps of:

(j) performing steps (b) and (c) during a first one of the predetermined recurring intervals of time; and (k) performing steps (e) and (f) during a second one of the predetermined recurring intervals of time.

10. The method according to claim 7 or 8
CHARACTERIZED IN THAT
the method comprises the further steps of:

(j) performing steps (b) and (c) during a first portion of a particular predetermined recurring interval of time; and (k) performing steps (e) and (f) during a second portion of said particular predetermined recurring interval of time.

11. The method according to claim 7
CHARACTERIZED IN THAT
the method comprises the further steps of:

(i) modulating the first signal ($\omega_c$) received by said second one of the plurality of n feed elements with said second signal ($\omega_p$) to produce a lower sideband signal thereof, (j) concurrent with step (i), modulating the first signal ($\omega_c$) received by the third one of the plurality of n feed elements with said second signal ($\omega_p$) to produce an upper sideband signal thereof;

(k) measuring the phase angle between the upper and lower sideband signals generated in steps (i) and (j) which phase angle is representative of the phase setting between the second and third ones of the feed elements; and (l) determining and storing the difference between the phase angles measured in steps (g) and (k), which difference is representative of the actual phase setting for said second one of the feed elements with respect to said first one of the feed elements.

12. The method according to claim 8 CHARACTERIZED IN THAT the method comprises the further steps of:

(j) modulating the first signal ($\omega_c$) received by said second one of the plurality of n feed elements with the second signal ($\omega_p$) to produce a lower sideband signal thereof;

(k) concurrent with step (j), modulating the first signal ($\omega_c$) received by one of the third of n ones of the plurality of n feed elements with said second signal ($\omega_p$) to produce an upper sideband thereof;

(l) measuring the phase angle between the upper and lower sideband signals generated in steps (j) and (k), which phase angle is representative of the phase setting between the second one and the third to n one used in step (k) of the plurality of n feed elements; and (m) determining and storing the difference between the phase angle measured in step (l) and the phase angle measured in step (i) when the reiterated step (g) used the same feed element to produce the upper sideband signal in step (f) as was used with step (k), which difference is representative of the actual phase setting for said second one of the feed elements with respect to said first one of the feed elements.

* * * * *